US009568933B2

(12) United States Patent
Pottbaecker et al.

(10) Patent No.: US 9,568,933 B2
(45) Date of Patent: Feb. 14, 2017

(54) CIRCUIT AND METHOD FOR GENERATING A BANDGAP REFERENCE VOLTAGE

(71) Applicant: STMicroelectronics R&D (Shanghai) Co. Ltd., Shanghai (CN)

(72) Inventors: Ansgar Pottbaecker, Grafing (DE); Panny Cai, Shanghai (CN)

(73) Assignees: STMicroelectronics R&D (Shanghai) Co. Ltd., Shanghai (CN); STMicroelectronics Application GmbH, Ascheim-Dornach (DE)

( * ) Notice: Subject to any disclaimer, the term of this patent is extended or adjusted under 35 U.S.C. 154(b) by 596 days.

(21) Appl. No.: 14/020,949

(22) Filed: Sep. 9, 2013

(65) Prior Publication Data

US 2014/0070788 A1 Mar. 13, 2014

(30) Foreign Application Priority Data

Sep. 11, 2012 (CN) ..... 2012 1 0341692

(51) Int. Cl.

| | |
|---|---|
| ***G05F 3/16*** | (2006.01) |
| ***G05F 3/08*** | (2006.01) |
| ***G05F 3/30*** | (2006.01) |
| *G05F 3/22* | (2006.01) |

(52) U.S. Cl.

CPC . *G05F 3/08* (2013.01); *G05F 3/30* (2013.01); *G05F 3/22* (2013.01)

(58) Field of Classification Search

CPC ..... G05F 3/16–3/247; G05F 3/08

See application file for complete search history.

(56) References Cited

U.S. PATENT DOCUMENTS 5,132,556 A * 7/1992 Cheng ..... G05F 3/30 323/315
2007/0279030 A1 12/2007 Cave
2008/0258804 A1* 10/2008 Kutz ..... H03K 19/177 327/539

(Continued)

FOREIGN PATENT DOCUMENTS

| | | | |
|---|---|---|---|
| CN | 100589060 | C | 2/2010 |
| CN | 102144196 | A | 8/2011 |
| CN | 202870665 | U | 4/2013 |

OTHER PUBLICATIONS

Chinese Office Action for CN201210341692.7 dated Dec. 4, 2014 (10 pages).

(Continued)

*Primary Examiner* — Jessica Han
(74) *Attorney, Agent, or Firm* — Gardere Wynne Sewell, LLP

(57) ABSTRACT

A bandgap reference voltage generator includes a bipolar assembly having a first resistor, a first branch and a second branch that is in parallel with the first branch. The first branch includes a first bipolar transistor with a base coupled to a fixed voltage. The second branch includes a second bipolar transistor with a base coupled to the fixed voltage and a second resistor coupled in series with the second bipolar transistor. A differential module is coupled to the first and second bipolar transistors and configured to balance the currents in the first and the second branches. The bandgap reference voltage is output at a node to which the first resistor is connected.

17 Claims, 5 Drawing Sheets

(56) References Cited

U.S. PATENT DOCUMENTS

| | | | | |
|---|---|---|---|---|
| 2009/0021234 | A1* | 1/2009 | Hsieh | G05F 3/30 323/313 |
| 2012/0068685 | A1* | 3/2012 | Chang | G05F 3/30 323/313 |
| 2013/0169259 | A1* | 7/2013 | Saxena | G05F 3/30 323/313 |
| 2013/0249527 | A1* | 9/2013 | Arnold | G05F 3/30 323/314 |

OTHER PUBLICATIONS

Chinese Second Office Action for CN201210341692.7 dated Jul. 9, 2015 (5 pages).

* cited by examiner

CIRCUIT AND METHOD FOR GENERATING A BANDGAP REFERENCE VOLTAGE

PRIORITY CLAIM

This application claims priority from Chinese Application for Patent No. 201210341692.7 filed Sep. 11, 2012, the disclosure of which is incorporated by reference.

TECHNICAL FIELD

This invention relates generally to electronic circuits, and more particularly to bandgap reference voltage circuits.

BACKGROUND

The bandgap reference voltage circuit is widely used in various applications for providing a stable voltage reference.

As shown in FIG. 1, an example of bandgap reference voltage circuit comprises a first npn bipolar transistor 4, in diode connection, whose emitter terminal is grounded whereas the collector terminal is connected with an end of a first resistor 1. The first resistor 1 has the other end connected with a positive input node of an operational amplifier 6 and with an end of a second resistor 2. The second resistor 3 has the other end connected to the output node 7 of the operational amplifier 6 and an end of a third resistor 3 that has the other end connected to a negative input node of the operational amplifier 6 and the collector of a second npn bipolar transistor 5. The voltage $V_{BG}$ at the output node 7 of the operational amplifier 6 is given by the sum of a base-emitter voltage of the second npn bipolar transistor 5 and the voltage across the third resistor 3, that is:

$$V_{BG} = V_{BE2} + V_T \frac{R2}{R1} \ln \frac{N \cdot R2}{R3}$$

where $V_T$ is the thermal voltage, R1, R2 and R3 are resistances of resistors 1, 2 and 3, and N is the area ratio of transistors 4 and 5.

The variation of $V_{BE}$ with temperature is −2.2 mV/, while $V_T$ is 0.086 mV/. The values of R1, R2, R3 and N are selected to ensure that $V_{BG}$ remain substantially stable over a range of temperature.

SUMMARY

It is noted that the type of circuit configuration of FIG. 1 as well as existing bandgap reference circuits typically provide a reference voltage of 1.25 V, and do not allow to meet the requirements for different levels of reference voltages or a higher level of reference voltage. Additionally, the existing bandgap reference circuits typically employ diode-connected bipolar transistors (as transistors 4 and 5 shown in FIG. 1) which are sensitive to substrate injections and/or noises.

To better address one or more of these concerns, in one embodiment, there is provided a circuit for generating a bandgap reference voltage, comprising a bipolar assembly. The bipolar assembly comprises, in series, a first resistor and a first branch that is in parallel with a second branch, the first branch comprising a first bipolar transistor with a base coupled to a fixed voltage, the second branch comprising a second bipolar transistor with a base coupled to a fixed voltage and a second resistor in series with the second bipolar transistor. The circuit further comprises a module configured to balancing the currents in the first and the second branches, the reference voltage being provided at a node of the first resistor.

Optionally, the first and the second bipolar transistors are p-n-p bipolar transistors, and the bases of the first and the second bipolar transistors are coupled to ground.

Optionally, the circuit further comprises a p-n junction, coupled in series with bipolar assembly, the p-n junction being a junction of a diode or a diode-connected bipolar transistor, wherein the first resistor is adjustable and the reference voltage is selectively provided at the node of the p-n junction.

Optionally, the second resistor comprises at least two types of resistors with different temperature coefficients, being configured so that the second resistor has a temperature coefficient in a range of 3000 ppm/K to 3500 ppm/K.

In one embodiment, there is provided a method for generating a bandgap reference voltage, comprising the steps of: coupling bases of a first and a second bipolar transistors to a fixed voltage; and generating the bandgap reference voltage by adding a base-emitter voltage of the first bipolar transistor and a voltage based on a difference between the base-emitter voltage of the first bipolar transistor and a base-emitter voltage of the second bipolar transistor.

Optionally, the first and the second bipolar transistors are p-n-p bipolar transistors, and the bases of the first and the second bipolar transistors are coupled to ground.

Optionally, the method further comprises the step of providing a p-n junction, wherein the step of generating comprises generating the bandgap reference voltage by adding a forward voltage drop of the p-n junction, the base-emitter voltage of the first bipolar transistor and the voltage based on the difference.

The foregoing has outlined, rather broadly, features of the present disclosure. Additional features of the disclosure will be described, hereinafter, which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in different figures generally refer to corresponding parts unless otherwise indicated. The figures are drawn to clearly illustrate the relevant aspects of embodiments of the present disclosure and are not necessarily drawn to scale. To more clearly illustrate certain embodiments, a letter indicating variations of the same structure, material, or process step may follow a figure number.

DETAILED DESCRIPTION OF THE DRAWINGS

The making and using of embodiments are discussed in detail below. It should be appreciated, however, that the specific embodiments discussed are merely illustrative, and do not limit the scope of the invention.

Figure 2:
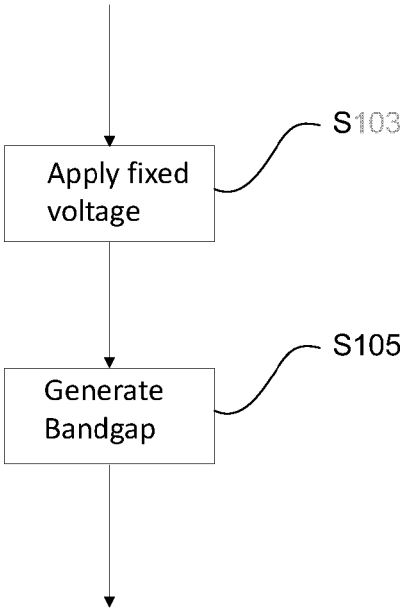
FIG. 2 illustrates a flow chart of a first embodiment.

FIG. 2 illustrates a flow chart of a first embodiment of a method. The method can be implemented with a first embodiment of the circuit 100 shown in FIG. 3.

Figure 3:
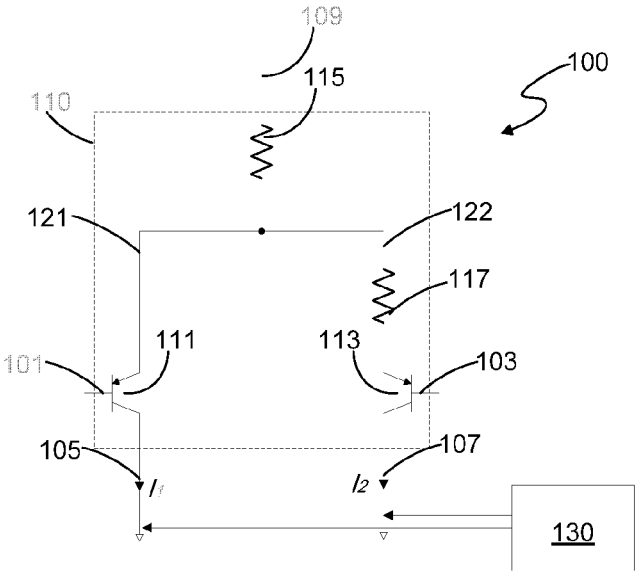
FIG. 3 illustrates a simplified circuit diagram of a first embodiment.

Referring to FIG. 3, the circuit 100 comprises a bipolar assembly 110 and a module 130. The bipolar assembly 110 comprises a first resistor 115, a first branch 121 in series with the first resistor 115, and a second branch 122 in parallel with the first branch 121. The first branch 121 comprises a first bipolar transistor 111, shown as a pnp transistor in FIG. 3. The second branch 122 comprises a second bipolar transistor 113, shown as a pnp transistor in FIG. 3, and a second resistor 117 in series with the second bipolar transistor 113. The module 130 is configured to balance the currents in the first and the second branches 121 and 122.

According to the method of FIG. 2, in Step S103, bases of a first bipolar transistor and a second bipolar transistor are coupled to a fixed voltage.

In FIG. 3, the base 101 of the first bipolar transistor 111 and the base 103 of the second bipolar transistor 113 are respectively connected to a fixed low voltage. For example, the bases 101 and 103 may be connected to ground, and the collectors may be connected to 0.1V.

Figure 1:
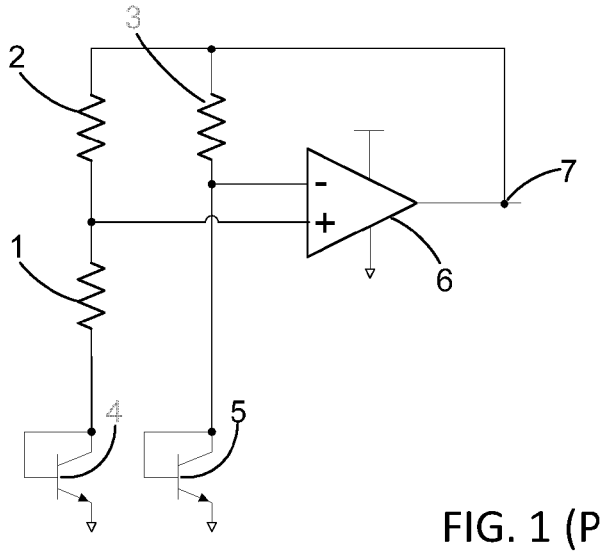
FIG. 1 (Prior Art)
FIG. 1 illustrates an example of conventional bandgap reference voltage circuit.

As compared to the circuit of FIG. 1, the substrate injections and/or noises influence on the bandgap reference voltage is reduced or eliminated. Such substrate injections and/or noises may be generated by, for example, power switches which reside on the common substrate, and may result in an error in the bandgap reference voltage. Specifically, referring to FIG. 1, when the substrate draws a current from the base or injects a current to the base, the voltage at the base tends to change because the base is connected to a "weak" voltage. By comparison, referring to FIG. 3, the bases 101 and 103 are coupled to a fixed voltage, for example, ground, the voltage at the bases 101 and 103 are fixed even if the substrate draws a current from the base or injects a current to the base. As a result, the substrate injections and/or noises influence on the bandgap reference voltage is reduced or eliminated. In other words, the bandgap reference voltage circuit 100 is insensitive to substrate currents. This allows the bandgap reference voltage circuit 100 to be operated at a low current. Therefore, the circuit 100 is advantageous in low power applications.

According to the method of FIG. 2, in Step S105, the bandgap reference voltage is generated by adding a base-emitter voltage of the first bipolar transistor and a voltage based on a difference between the base-emitter voltage of the first bipolar transistor and a base-emitter voltage of the second bipolar transistor.

Referring to FIG. 3, the voltage across the second resistor 117 is determined by the difference between the base-emitter voltages of the first and the second bipolar transistors 111 and 113. Assuming the emitter currents of the first and the second bipolar transistors 111 and 113 are the same, the voltage across the second resistor 117 is given by:

$$V_{R117} = \Delta V_{BE} = V_T \ln\frac{I_{E111}}{I_{S111}} - V_T \ln\frac{I_{E113}}{I_{S113}} = V_T \ln\frac{I_{S113}}{I_{S111}} = V_T \ln N$$

where N is the area ratio of transistor 113 to transistor 111.

Therefore, the emitter currents of the first and second transistors 111 and 113 are given by:

$$I_{E111} = I_{E113} = \frac{V_T \ln N}{R_{117}}$$

The bandgap reference voltage provided at the node 109 of the first resistor 115 is given by:

$$V_{BG} = V_{EB111} + 2\frac{V_T \ln N}{R_{117}} R_{115}$$

The variation of $V_{EB111}$ with temperature is −2.2 mV/, while $V_T$ is 0.086 mV/. Therefore, by properly selecting the values of N, $R_{115}$ and $R_{117}$, the variations of $V_{EB111}$ and $$2\frac{V_T \ln N}{R_{117}} R_{115}$$

can cancel each other. In this way, a stable reference voltage is obtained.

Figure 4:
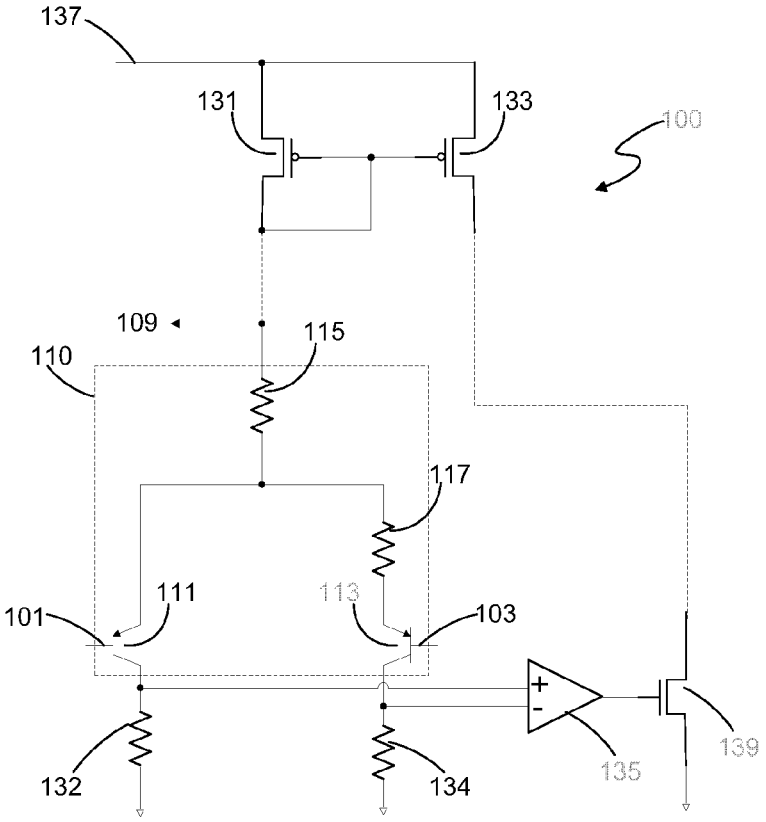
FIG. 4 illustrates a detailed circuit diagram of a module of the circuit of FIG. 3.

FIG. 4 illustrates a detailed circuit diagram of the module 130 of the circuit 100 of FIG. 3.

As shown in FIG. 4, the module 130 is implemented by using a current mirror and an operational amplifier 135. The current mirror comprises, from a first supply voltage 137, a first MOS transistor 131 and a second MOS transistor 133. The operational amplifier 135 comprises a negative input node coupled to a collector of the first bipolar transistor 111, a positive input node coupled to a collector of the second bipolar transistor 113 and an output node coupled to the current mirror. By controlling a current through the current mirror, the operational amplifier 135 maintains substantially equal the voltages at the negative and positive input nodes. Resistors 132 and 134 of equal resistance are respectively connected to the negative and positive inputs of the operational amplifier 135, therefore the currents in the first and the second branches 121 and 122 are kept the same. Preferably, the module 130 may further comprise a MOS transistor 139 with a gate coupled to the output node of the operational amplifier 135.

The current through transistor 131 is given by:

$$I_{131} = 2\frac{V_T \ln N}{R_{117}}$$

Therefore, $$\frac{dI_{131}}{dT} = 2\frac{k}{q}(\ln N)\frac{R_{117} - T\,dR_{117}/dT}{R_{117}^2}$$

By choosing a resistor with a proper temperature coefficient, the variation of $V_T$ can be canceled. Specifically, $V_T$ has a temperature coefficient of approximately 3300 ppm/K, the resistor may have a temperature coefficient in a range of 3000 ppm/K to 3500 ppm/K, preferably of 3300 ppm/K. Thus $I_{131}$ is kept almost unchanging with temperature.

In general, the temperature dependence of resistance is given by:

$$R=R_0(1+T_{C1}(T-25)+T_{C2}(T^2-50T+625))$$

where $R_0$ is the resistance at room temperature (25), $T_{C1}$ is the first order coefficient and $T_{C2}$ is the second order coefficient.

In order to obtain a resistor with a proper temperature coefficient, two types of resistors with different temperature coefficients can be combined.

For example, a body resistor has a $T_{C1}$ of $4.1\times10^{-3}$ and a $T_{C2}$ of $7.2\times10^{-6}$, and a ZEN resistor has a $T_{C1}$ of $2.06\times10^{-4}$ and a $T_{C2}$ of $3.08\times10^{-6}$.

By selecting a proper combining ratio of the body resistor and the ZEN resistor, a resistor having a temperature coefficient substantially the same as that of $V_T$ can be obtained. In this way, the current through transistor 131 is nearly unchanging with temperature. The current can be provided to other circuits or blocks as a reference current.

From the foregoing, the circuit 100 of FIG. 4 not only provides a substrate-current insensitive bandgap reference voltage, but also provides a temperature insensitive reference current. Thus the circuit 100 saves chip area and power for additional reference current circuits or blocks.

In an example, each of the resistors 115, 117, 132 and 134 comprises at least two types of resistors with different temperature coefficients.

In an example, the operational amplifier 135 is a two stage amplifier which has a low offset voltage.

It will be appreciated that the module 130 other elements, for example, MOS transistor, capacitors and resistors, besides the amplifier 135 and the current mirror, for purpose of providing static operating point or some other purposes.

It will be further appreciated that, the configuration of module 130 shown in FIG. 4 is just illustrative. The module 130 may have a variety of configurations. For example, the module 130 can be implemented by a current source delivering currents of equal value in the first and the second branches 121 and 122.

Another benefit that can be realized by the circuit 100 of FIG. 4 is that the influence of the offset voltage of the operational amplifier 135 can be reduced. This is discussed in detail below.

In the circuit of FIG. 1, if the offset voltage of the operational amplifier 6 is considered, the bandgap voltage will be:

$$V_{BG} = B_{BE2} + V_T\frac{R2}{R1}\ln\frac{N\cdot R2}{R3} \pm V_{OS}\left(1+\frac{R2}{R1}\right)$$

where $V_{OS}$ is the offset voltage of the operational amplifier 6.

Therefore, the error of bandgap reference voltage caused by the offset voltage of the amplifier 6 is $$V_{OS}\left(1+\frac{R2}{R1}\right)$$

By comparison, in the circuit of FIG. 4, if the offset voltage of the operational amplifier 135 is considered, the bandgap voltage will be:

$$V_{BG} = V_{EB111} + \left(1+\frac{V_P}{V_P+V_{OS}}\right)\frac{V_T R_{115}}{R_{117}}\ln N$$

where $V_{OS}$ is the offset voltage of the operational amplifier 135, and $V_P$ is the voltage at the positive input of the operational amplifier 135.

Therefore, the error of bandgap reference voltage caused by the offset voltage of the amplifier 135 is $$\left(\frac{V_{OS}}{V_P+V_{OS}}\right)\frac{V_T R_{115}}{R_{117}}\ln N$$

Assuming, the amplifiers 6 and 135 have the same offset voltage, N is 8, and $V_P$ is 0.1 V, then the error of bandgap reference voltage caused by the offset voltage of the amplifier 135 is approximately half of the error of bandgap reference voltage caused by the offset voltage of the amplifier 6.

Thus the circuit 100 of FIG. 4 has reduced requirements for the offset voltage of operational amplifiers. In other words, amplifiers offering a moderate offset voltage can be adopted. By adopting amplifiers with a moderate offset voltage, the circuit size can be decreased. This is discussed below.

A random offset voltage inherent to a MOS transistor pair of operational amplifiers is a function of the root square gate transistor area:

$$V_{OS} = \frac{K}{\sqrt{a_g}}$$

where $a_g$ is the gate transistor area and K is an empirical constant depending on physical parameters.

It can be seen that, in order to reduce the offset voltage $V_{OS}$ by a factor of two, MOS transistors with four times the gate area are needed. That is to say, to have a similar level of error of bandgap reference voltage, the amplifier 6 of the circuit shown in FIG. 1 needs to be four times the size of the amplifier 135 of the circuit 100 shown in FIG. 4.

Figure 5:
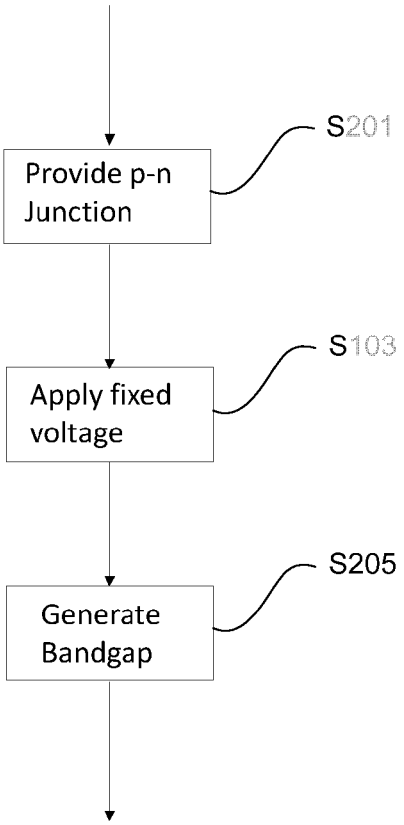
FIG. 5 illustrates a flow chart of a second embodiment.

FIG. 5 illustrates a flow chart of a second embodiment of the method according to the invention. The method can be implemented with a second embodiment of the circuit 200 shown in FIG. 6.

According to FIG. 5, the method, with respect to the method of FIG. 2, further comprises a step S201 of providing a p-n junction.

Figure 6:
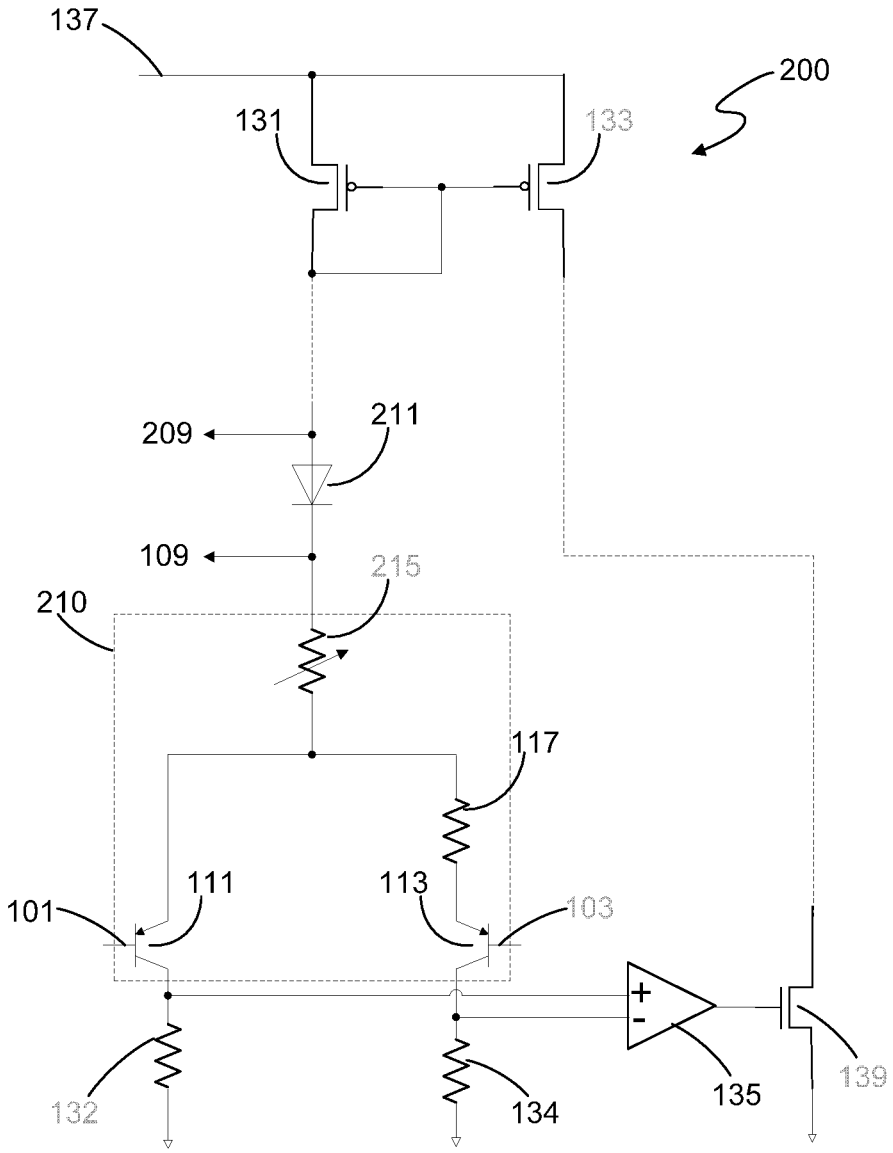
FIG. 6 illustrates a simplified circuit diagram of a second embodiment.

Referring to FIG. 6, with respect to the circuit 100, the circuit 200 further comprises a p-n junction 211, coupled in series with bipolar assembly 210. The p-n junction 211 is shown as a junction of a diode. However, it should be noted that a p-n junction of a diode-connected bipolar transistor is also applicable. The first resistor 215 of the bipolar assembly 210 is adjustable so that different bandgap reference voltages at node 109 and node 209 can be selectively provided.

When the bandgap reference voltage is provided at the node 109 of the first resistor 215, the reference voltage is given by:

$$V_{BG1} = V_{EB111} + 2\frac{V_T \ln N}{R_{117}} R_{215(1)}$$

where the resistance $R_{215(1)}$ of the first resistor 215 is selected so that the variation of $$2\frac{V_T \ln N}{R_{117}} R_{215(1)}$$

cancel the variation of $V_{EB111}$. Typically, $V_{BG1}$ is around 1.25 V.

According to the method of FIG. 5, in Step S205, the bandgap reference voltage is generated by adding a forward voltage drop of the p-n junction, the base-emitter voltage of the first bipolar transistor and the voltage based on the difference between the base-emitter voltage of the first bipolar transistor and a base-emitter voltage of the second bipolar transistor.

When the bandgap reference voltage is provided at the node 209 of the diode 211, the reference voltage is given by:

$$V_{BG2} = V_{211} + V_{EB111} + 2\frac{V_T \ln N}{R_{117}} R_{215(2)}$$

where $V_{211}$ is the forward voltage drop of the diode 211, and the resistance $R_{215(2)}$ of the first resistor 215 is selected so that the variation of $$2\frac{V_T \ln N}{R_{117}} R_{215(2)}$$

cancel the variation of $V_{211}+V_{EB111}$. Typically, $V_{BG2}$ is around 2.5 V.

From the forgoing, in addition to the benefit(s) that can be realized by the circuit 100, the circuit 200 can provide different levels of bandgap reference voltages by providing a p-n junction 211 in series with the bipolar assembly 210 and adjusting the resistance of the resistor 215.

The circuit 200 may be particularly advantageous in applications, including, but not limited to, those requiring different levels of reference voltages or a higher level of reference voltage.

In a preferred example, the diode 211 is a pocket free diode, i.e., the n well where the diode 211 resides is connected to a high voltage to reduce or substrate injections.

In order to make the first and the second transistors 111 and 113 have equal emitter currents, it is required that the transistors 111 and 113 have equal collector currents. To eliminate or reduce the influence of possible parasitic C-B-SUB and E-B-SUB currents through the transistors, the bipolar assembly further comprises at least one bipolar transistor connected in parallel with the first bipolar transistor 111. The at least one bipolar transistor is configured so that a sum of collector areas of the at least one and the first bipolar transistors is equal to a collector area of the second bipolar transistor. Such configured, a sum of the possible parasitic C-B-SUB and E-B-SUB currents of the at least one bipolar transistor and the first bipolar transistor 111 is the same as the possible parasitic C-B-SUB and E-B-SUB currents of the second bipolar transistor 113.

Figure 7:
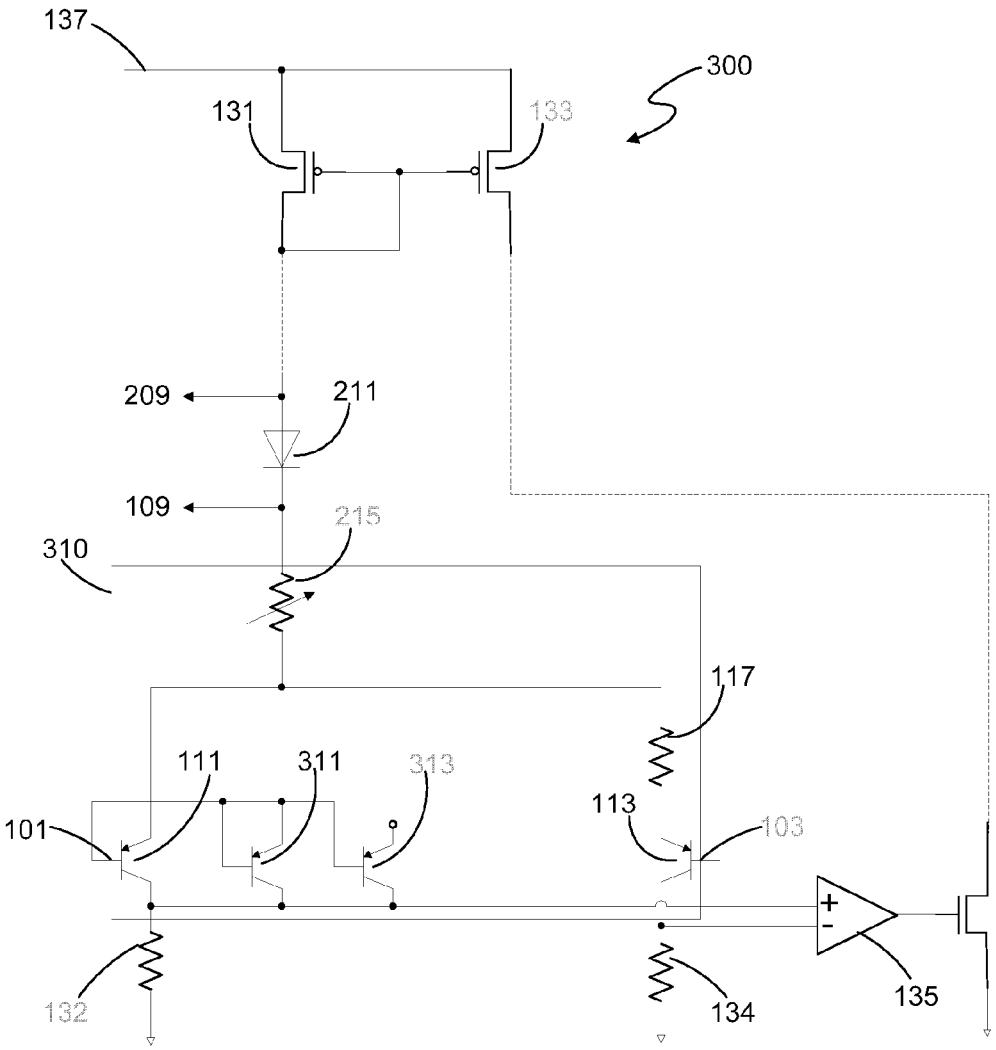
FIG. 7 illustrates a simplified circuit diagram of a third embodiment.

FIG. 7 illustrates a simplified circuit diagram of a third embodiment of the circuit 300.

As shown in FIG. 7, with respect of the bipolar assembly 110, the bipolar assembly 310 further comprises a third bipolar transistor 311 and a fourth bipolar transistor 313. The base and the emitter of the third bipolar transistor 311 are connected to the base of the first bipolar transistor 111, and the collector of the third bipolar transistor 311 is connected to the collector of the first bipolar transistor 111. The base of the fourth bipolar transistor 313 is connected to the base of the first bipolar transistor 101, the collector of the fourth bipolar transistor 313 is connected to the collector of the first bipolar transistor 101.

The third bipolar transistor 311 and the fourth bipolar transistor 313 are configured so that a sum of collector areas of the first, the third and fourth transistors (111, 311 and 313) is equal to a collector area of the second bipolar transistor 113. In one example, assuming the collector area of the first transistor 111 is A and the collector area of the second transistor 113 is 8 A, the third transistor 311 may have a collector area of 4 A and the fourth transistor 313 may have a collector area of 3 A.

In addition, it will be noted that when temperature increases, the bandgap reference voltage decreases drastically and the bandgap reference voltage-temperature curve becomes asymmetric which is undesirable for a reference circuit. The possible reason for such phenomenon is as follows: if the circuit works in a low current consumption mode, the currents flowing through transistors 111 and 113 are small, and the current density of the second transistor 113 is smaller than that of the first transistor 111. As a result, the emitter-base voltage of the first transistor 111 tends to decrease more rapidly than that of the second transistor 113 does. Therefore, $d(V_{EB111}V_{EB113})/dT$ decreases at high temperatures. Accordingly, the reference voltage-temperature curve becomes asymmetric.

To address the above problem, the emitter is connected to the base of the third bipolar transistor 311. When temperature increases, C-B-E current of the third transistor 311 increases rapidly, which causes an additional current injection into the emitter of the first bipolar transistor 111. This generates a second order compensation for the temperature coefficient of the bandgap reference voltage.

Figure 8:
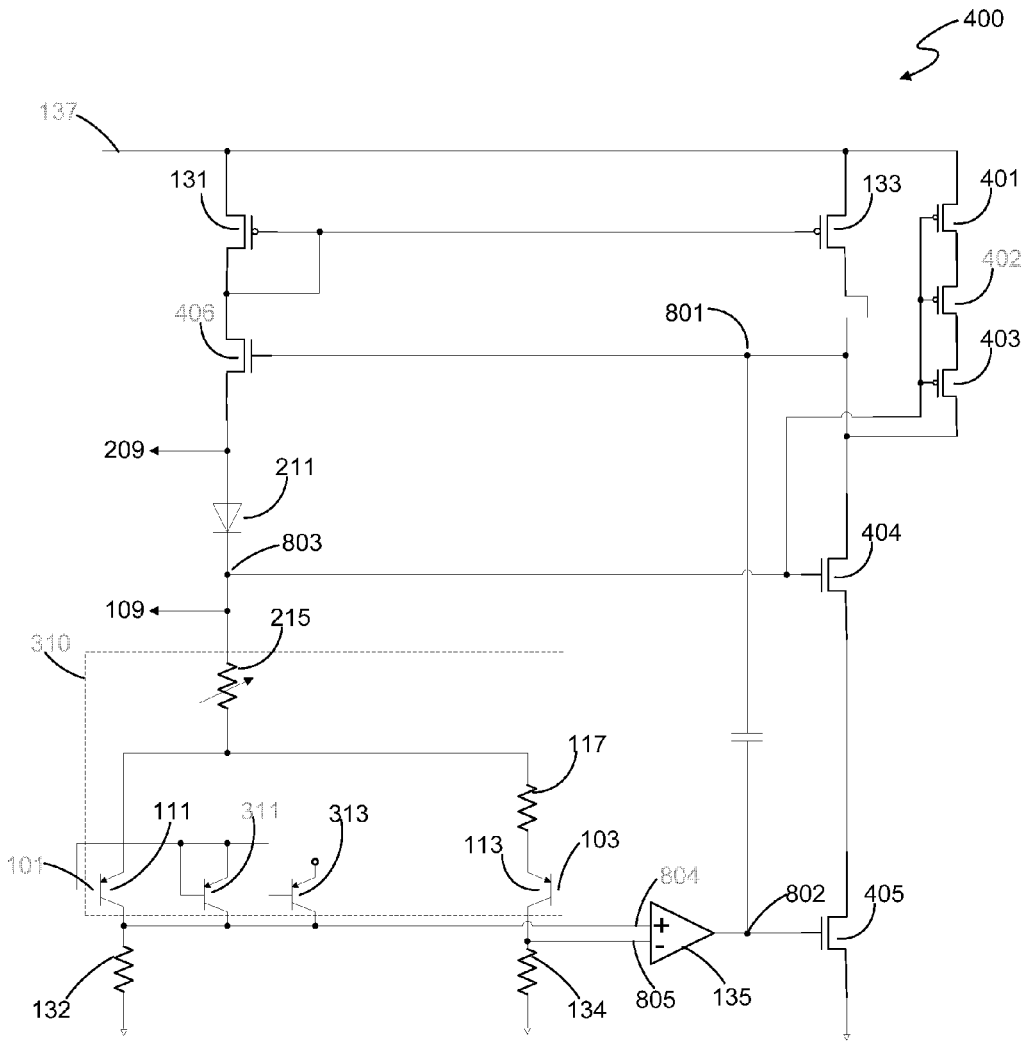
FIG. 8 illustrates the circuit of FIG. 7 used with a start up circuit.

FIG. 8 illustrates the circuit of FIG. 7 used with a start up circuit.

As shown in FIG. 8, the voltage at node 209 is zero when the voltage 137 is zero. When the voltage 137 goes higher than the threshold voltage of transistor 401, the transistors 401, 402 and 403 are turned on, as a result, the nodes 801 and 802 are charged.

The MOS transistor 131 is turned on and start to conduct current when the following relationships are satisfied: $V_{137}>V_{t_131}+2V_{BE}$, $V_{801}>V_{t_406}+2V_{BE}$, and $V_{803}<V_{t_404}$, where $V_{137}$ is the voltage at node 137, $V_{t_131}$ is the threshold voltage of transistor 131, $V_{801}$ is the voltage at node 801, $V_{t_406}$ is the threshold voltage of the transistor 406, $V_{803}$ is the voltage at node 803, and $V_{t_404}$ is the threshold voltage of transistor 404. At this time, the transistor 405 has no current because the transistor 404 is off.

When $V_{803}$ is higher than $V_{t_404}$, $V_{137}\approx V_{BG_target}+V_{DS_406}+V_{GS_131}$, where $V_{BG_target}$ is the target bandgap reference voltage, $V_{DS_406}$ is the drain-source voltage of transistor 406 and $V_{GS_131}$ is the gate-source voltage of transistor 131. Because the voltage at node 804 is lower than the voltage at node 805, the amplifier 135 works as a comparator. As a result, the voltage at node 802 is zero and the transistor 405 is off.

When $V_{137}$ goes a little higher than $V_{BG_target}+V_{DS_406}+V_{GS_131}$, the voltage at node 804 is higher than the voltage at node 805. As a result, the transistor 405 is turned on and the feedback loop of the amplifier 135 works. Finally, the voltage at node 209 is stabilized at target bandgap reference voltage.

It will be appreciated that the start up circuit in FIG. 8 is just exemplary but not restrictive. Any circuit which can realize the start up of the bandgap reference circuit discussed above is appropriate.

In the disclosure herein, operations of circuit embodiment(s) may be described with reference to method embodiment(s) for illustrative purposes. However, it should be appreciated that the operations of the circuits and the implementations of the methods in the disclosure may be independent of one another. That is, the disclosed circuit embodiments may operate according to other methods and the disclosed method embodiments may be implemented through other circuits.

It will also be readily understood by those skilled in the art that materials and methods may be varied while remaining within the scope of the present invention. It is also appreciated that the present invention provides many applicable inventive concepts other than the specific contexts used to illustrate embodiments. Accordingly, the appended claims are intended to include within their scope such processes, machines, manufacturing, compositions of matter, means, methods, or steps.

What is claimed is:

1. A circuit for generating a bandgap reference voltage, comprising:

a bipolar assembly, comprising a first resistor, a first branch coupled in series with the first resistor and a second branch coupled in parallel with the first branch, the first branch comprising a first bipolar transistor with a base coupled to a fixed voltage node, the second branch comprising a second bipolar transistor with a base coupled to said fixed voltage node and a second resistor coupled in series with the second bipolar transistor; and a module configured to balance currents in the first and the second branches, said module comprising an operational amplifier having a first input node coupled to a collector of the first bipolar transistor, a second input node coupled to a collector of the second bipolar transistor, and an output node coupled to the first resistor, the operational amplifier configured to maintain substantially equal the voltages at the first and second input nodes by controlling a current in the first resistor, wherein the bandgap reference voltage is configured to be provided at a node of the first resistor.

2. The circuit of claim 1, wherein the first and second bipolar transistors are p-n-p bipolar transistors, and the bases of the first and second bipolar transistors are coupled to a ground reference node.

3. A circuit for generating a bandgap reference voltage, comprising:

a bipolar assembly, comprising a first resistor, a first branch coupled in series with the first resistor and a second branch coupled in parallel with the first branch, the first branch comprising a first bipolar transistor with a base coupled to a fixed voltage node, the second branch comprising a second bipolar transistor with a base coupled to said fixed voltage node and a second resistor coupled in series with the second bipolar transistor; and a module configured to balance currents in the first and the second branches, wherein the module comprises:

a current mirror coupled to the first resistor and comprising, connected to a first supply voltage node, a first MOS transistor and a second MOS transistor; and an operational amplifier, comprising a first input node coupled to a collector of the first bipolar transistor, a second input node coupled to a collector of the second bipolar transistor, and an output node coupled to the second MOS transistor, the operational amplifier configured to maintain substantially equal the voltages at the first and second input nodes by controlling a current through the current mirror, and wherein the bandgap reference voltage is configured to be provided at a node of the first resistor.

4. The circuit of claim 3, wherein the operational amplifier is a two stage operational amplifier.

5. The circuit of claim 3, wherein the second resistor comprises at least two types of resistors with different temperature coefficients, being configured so that the second resistor has a temperature coefficient in a range of 3000 ppm/K to 3500 ppm/K.

6. A circuit for generating a bandgap reference voltage, comprising:

a bipolar assembly, comprising a first resistor, a first branch coupled in series with the first resistor and a second branch coupled in parallel with the first branch, the first branch comprising a first bipolar transistor with a base coupled to a fixed voltage node, the second branch comprising a second bipolar transistor with a base coupled to said fixed voltage node and a second resistor coupled in series with the second bipolar transistor; and a p-n junction, coupled in series with the first resistor of said bipolar assembly, and a module configured to balance currents in the first and the second branches, wherein the first resistor is adjustable, and wherein the bandgap reference voltage is selectively provided at one node of the p-n junction.

7. The circuit of claim 6, wherein an n well where the p-n junction resides is connected to a high voltage node.

8. The circuit of claim 6, wherein the p-n junction is one of a junction of a diode or a diode-connected bipolar transistor.

9. A circuit for generating a bandgap reference voltage, comprising:

a bipolar assembly, comprising a first resistor, a first branch coupled in series with the first resistor and a second branch coupled in parallel with the first branch, the first branch comprising a first bipolar transistor with a base coupled to a fixed voltage node, the second branch comprising a second bipolar transistor with a base coupled to said fixed voltage node and a second resistor coupled in series with the second bipolar transistor; and wherein the bipolar assembly further comprises:

a third bipolar transistor connected with the first bipolar transistor, wherein a base and an emitter of the third bipolar transistor are connected to a base of the first bipolar transistor and a collector of the third bipolar transistor is connected to a collector of the first bipolar transistor.

10. The circuit of claim 9, further comprising a fourth bipolar transistor, a base of the fourth bipolar transistor being connected to the base of the first bipolar transistor, and a collector of the fourth bipolar transistor being connected to the collector of the first bipolar transistor.

11. A circuit, comprising:

a current mirror circuit including a first mirror transistor and a second mirror transistor;

a first branch including a first bipolar transistor;

a second branch including a second bipolar transistor connected in series with a first resistor, said first and second branches coupled in parallel with each other at a node;

a second resistor coupled between the node and the first mirror transistor; and a differential circuit configured to sense current in the first and second branches and output a control signal coupled to control operation of the current mirror circuit.

12. The circuit of claim 11, wherein the second resistor is a variable resistor.

13. The circuit of claim 11, further comprising a p-n junction coupled in series with the second resistor between the node and the first mirror transistor.

14. The circuit of claim 11, wherein base terminals of the first and second bipolar transistors are coupled to receive a same fixed voltage from a voltage node.

15. The circuit of claim 11, further comprising:

a third resistor coupled in series with the first branch between the first bipolar transistor and a reference voltage node; and a fourth resistor coupled in series with the second branch between the second bipolar transistor and said reference voltage node.

16. The circuit of claim 11, wherein said first branch further includes at least one additional bipolar transistor having a base terminal and emitter terminal coupled to a base terminal of the first bipolar transistor and having a collector terminal coupled to a collector terminal of the first bipolar transistor.

17. The circuit of claim 16, wherein the first branch further includes at least one further bipolar transistor having a base terminal and emitter terminal coupled to a base terminal of the first bipolar transistor.

* * * * *